US008661609B2

(12) United States Patent
Knopow et al.

(10) Patent No.: US 8,661,609 B2
(45) Date of Patent: Mar. 4, 2014

(54) PORTABLE DEVICES FOR TOUCHLESS PARTICULATE MATTER REMOVAL

(75) Inventors: Jeremy F. Knopow, Burlington, WI (US); Steven Merrill Harrington, Cardiff, CA (US); Andrew L. Banka, Ann Arbor, MI (US); Paul J. Larson, Racine, WI (US); Ernst K. Reiter, Waterloo (CA)

(73) Assignee: S.C. Johnson & Son, Inc., Racine, WI (US)

( * ) Notice: Subject to any disclaimer, the term of this patent is extended or adjusted under 35 U.S.C. 154(b) by 209 days.

(21) Appl. No.: 12/998,787

(22) PCT Filed: Dec. 3, 2009

(86) PCT No.: PCT/US2009/006349

§ 371 (c)(1),
(2), (4) Date: Aug. 4, 2011

(87) PCT Pub. No.: WO2010/065115

PCT Pub. Date: Jun. 10, 2010

(65) Prior Publication Data

US 2011/0277270 A1 Nov. 17, 2011

Related U.S. Application Data

(60) Provisional application No. 61/119,586, filed on Dec. 3, 2008.

(51) Int. Cl.
*A47L 5/14* (2006.01)

(52) U.S. Cl.
USPC ..... 15/345; 15/200

(58) Field of Classification Search
USPC ..... 15/320–322, 405, 344, 345, 404
See application file for complete search history.

(56) References Cited

U.S. PATENT DOCUMENTS

| | | | |
|---|---|---|---|
| 868,901 | A | 10/1907 | Williams |
| 3,328,827 | A | 7/1967 | Lake |
| 3,678,534 | A | 7/1972 | Hilbig |

(Continued)

FOREIGN PATENT DOCUMENTS

| | | |
|---|---|---|
| EP | 0640411 | 3/1995 |
| GB | 1211930 | 11/1970 |

(Continued)

OTHER PUBLICATIONS

PCT/US2009/006349 Internations Search Report.

(Continued)

*Primary Examiner* — Dung Van Nguyen

(57) ABSTRACT

Portable devices for dislodging and/or capturing particulate matter that has accumulated on various surfaces or structures are provided. The devices include a body segment and a nose segment extending away therefrom. A high-pressure assembly generates a high-pressure airflow that is directed to a nozzle assembly in the nose segment. From the nozzle assembly, the high-pressure airflow can be emitted from multiple nozzles as a series of airflow bursts that discretely contact the surface from which the particulate matter is being dislodged. The configuration of each nozzle, as well as the overall arrangement and positions of all the nozzles together, is selected to impart the desired particulate matter dislodging characteristics to the device, and the device may incorporate a vacuum airflow to remove the particulate matter after such matter has been dislodged.

10 Claims, 9 Drawing Sheets

(56) References Cited

U.S. PATENT DOCUMENTS

| | | | | |
|---|---|---|---|---|
| 3,774,262 | A * | 11/1973 | Anthony et al. | 15/322 |
| 4,282,626 | A | 8/1981 | Schneider | |
| 4,629,128 | A | 12/1986 | Lawrence | |
| 4,651,381 | A * | 3/1987 | Meidel | 15/345 |
| 4,905,500 | A * | 3/1990 | Mason | 73/38 |
| 4,945,604 | A | 8/1990 | Miner et al. | |
| 5,184,372 | A | 2/1993 | Mache | |
| 5,187,635 | A | 2/1993 | Yehl | |
| 5,197,160 | A * | 3/1993 | Smith | 15/306.1 |
| 5,279,076 | A | 1/1994 | Healy et al. | |
| 5,457,847 | A | 10/1995 | Uzawa et al. | |
| 5,477,585 | A | 12/1995 | Hentzchel | |
| 5,485,651 | A | 1/1996 | Payeur | |
| 5,577,294 | A | 11/1996 | Pollock | |
| 5,884,360 | A | 3/1999 | Palffy | |
| 6,123,618 | A | 9/2000 | Day | |
| 6,141,823 | A | 11/2000 | Fujiwara et al. | |
| 6,141,824 | A | 11/2000 | Fujiwara et al. | |
| 6,148,831 | A | 11/2000 | Lindstrom et al. | |
| 6,151,748 | A | 11/2000 | Earhart, Jr. | |
| 6,249,932 | B1 * | 6/2001 | Chu et al. | 15/345 |
| 6,719,830 | B2 | 4/2004 | Illingworth et al. | |
| 6,773,334 | B1 | 8/2004 | Mallison | |
| 6,782,583 | B2 | 8/2004 | Oh | |
| 7,018,438 | B2 | 3/2006 | Duggan | |
| 7,086,119 | B2 | 8/2006 | Go et al. | |
| 7,111,797 | B2 | 9/2006 | Bezama et al. | |
| 7,112,247 | B2 | 9/2006 | Stelcher et al. | |
| 7,357,823 | B1 | 4/2008 | Streciwilk | |
| 7,665,181 | B2 * | 2/2010 | Gebhard et al. | 15/320 |
| 2003/0097727 | A1 | 5/2003 | Keller | |
| 2005/0155176 | A1 | 7/2005 | Chen | |
| 2006/0213025 | A1 | 9/2006 | Sawalski | |
| 2006/0288495 | A1 | 12/2006 | Sawalski et al. | |
| 2006/0288516 | A1 | 12/2006 | Sawalski | |
| 2008/0141483 | A1 | 6/2008 | Pearlstein | |
| 2008/0155769 | A1 | 7/2008 | Schonewille et al. | |
| 2008/0178410 | A1 | 7/2008 | Salmon | |
| 2008/0178416 | A1 | 7/2008 | Conrad | |
| 2008/0184515 | A1 | 8/2008 | Chapman et al. | |
| 2008/0184518 | A1 | 8/2008 | Taylor et al. | |
| 2008/0189069 | A1 | 8/2008 | Beck | |
| 2008/0201899 | A1 | 8/2008 | Voorhorst et al. | |
| 2009/0044372 | A1 * | 2/2009 | Knopow et al. | 15/345 |

FOREIGN PATENT DOCUMENTS

| | | |
|---|---|---|
| GB | 2338404 | 12/1999 |
| GB | 2345839 | 7/2000 |
| JP | 2008-119266 | 5/2008 |
| WO | WO 00/25653 | 5/2000 |
| WO | WO 2008/048552 | 4/2008 |
| WO | WO 2008/092723 | 8/2008 |

OTHER PUBLICATIONS

PCT/US2009/006349 Written Opinion.
PCT/US2008/069531 International Search Report.
PCT/US2008/069531 Written Opinion.

* cited by examiner

PORTABLE DEVICES FOR TOUCHLESS PARTICULATE MATTER REMOVAL

CROSS-REFERENCE TO RELATED APPLICATIONS

This international application claims to benefit of and priority to U.S. Provisional Patent Application Ser. No. 61/119,586, filed on Dec. 3, 2008, the entirety of which is expressly incorporated by reference herein.

BACKGROUND OF THE INVENTION

1. Field of the Invention

The present invention relates to devices for removing airborne or settled particulates and debris from surfaces without contacting those surfaces and, more specifically, to portable devices for dislodging particulates and debris which have accumulated on various surfaces.

2. Discussion of the Related Art

In many environments, a number of airborne or settled particulates and debris, e.g., allergens, dust, dirt, soil and/or other matter, are present which can create any of a variety of problems. Some such airborne or settled particulates can accumulate on various surfaces and can be difficult to dislodge or move, when desired. Furthermore, in large quantities, settled particulates and debris can be increasingly difficult to dislodge or move once they have sufficiently adhered to a surface.

To manage, control, or otherwise influence the airborne travel or accumulation of airborne or settled particulates and debris, numerous known devices and procedures are utilized, depending on the particular environment or surface upon which the particulates and debris collects. As a first example, a number of different air cleaning and purification devices have been developed for building interiors which draw the air from the interior environments of the building through the device in order to filter and remove allergens, dust, or other particulates from the airflow passing through the device. However, such devices are unable to completely eliminate settling and accumulation of dust, allergens, debris, dirt, sand, soil and/or other airborne or settled particulates.

Removing settled particulates and debris from certain surfaces can prove especially tedious or otherwise difficult. For example, removing settled particulates and debris from areas with numerous small movable items typically requires removing the items from the underlying support surface.

Furthermore, removing settled particulates and debris from the small items themselves, likewise, can prove rather tedious. In some settings, the small items are removed from the underlying support surface and physically manipulated to expose the various outer surfaces of the small items to the settled particulates and debris removal device.

In a household environment, various devices, such as vacuum cleaners and their attachments, have been introduced to reduce the relative time required to perform settled particulate and debris removal tasks. However, the vast majority of these devices are relatively large and bulky. Accordingly, users must move such devices, e.g. vacuum cleaners, about the household while removing settled particulates and debris because users are tethered, to the devices, e.g. by way of a vacuum hose.

Also in the household environment, other devices, such as various handheld vacuum devices, have also been introduced to simplify some settled particulate and debris removal tasks. However, such devices are unable to draw enough vacuum pressure to dislodge settled particulates and debris, which might be stubbornly stuck to a surface, especially without actually touching the surface. In other words, the vacuum pressure generated by handheld vacuums is typically not strong enough to remove settled particulates and debris from, e.g., collectables or furniture with fine finishes. Since users of handheld vacuums often touch the dirty surface they are cleaning, the handheld vacuums become soiled themselves and users are thus reluctant to use such devices near fine collectibles and similar objects. Handheld vacuum devices typically have a narrow transversely extending slot as their inlets, rendering them ill suited for use with conventional side-to-side dusting strokes. In addition, such devices tend to be somewhat heavy and some are unacceptably loud, whereby extended periods of use can prove frustrating and/or fatiguing for the user.

Alternatively, in some settings or environments, the items are not capable of being either removed from the underlying support surface or physically manipulated to expose the various outer surfaces of the items to the settled particulates and debris removal device. Such items may be particularly fragile, delicate, may be affixed to the underlying support surface, or may be particularly heavy and/or otherwise potentially hazardous to move or physically manipulate. Accordingly, particulate and debris removal tasks can take a considerable amount of time to perform adequately.

In the commercial, industrial, and/or outdoor environments, various pneumatic devices have been used in attempts to remove dust, sawdust, metal shaving, sand, dirt, and/or other debris. Although such attempts have been at least somewhat successful, typically, such devices typically utilize a continuous air flow from a fixed-mounted air compressor and which require the production of large quantities of pressurized air. Such devices, by requiring large quantities of pressurized air, correspondingly require large amounts of power to operate the (high volume output) compressors. Other similar devices use pressurized liquid, either independently or in conjunction with a pressurized air flow, to perform settled particulate and debris removal. Accordingly, such devices are effectively limited by the necessary presence of a liquid volume.

Yet, other soil removal devices produce significantly forceful air currents, again typically by way of a continuous fluid flow. Such devices are not suitable for the removal of settled particulates and debris from the surfaces of fragile, delicate, or potentially hazardous items, as the surface of such items may become damaged during particulates and debris removal process. As applied to the unearthing of buried objects, high force air currents may damage buried objects such as underground utility lines.

Therefore, it is desirable to develop a relatively small, portable device, which is capable of dislodging accumulated particulates and debris from various surfaces, especially in a non-contact or touchless manner in some instances.

SUMMARY AND OBJECTS OF THE INVENTION

Consistent with the foregoing, and in accordance with the invention as embodied and broadly described herein, portable devices for touchless particulate matter removal are disclosed in suitable detail to enable one of ordinary skill in the art to make and use the invention.

According to a first embodiment of the present invention, a device is presented for dislodging particulate matter from a surface. The device includes a body segment and possibly also a nose segment that extends away from the body segment. A high-pressure assembly for generating a high-pressure fluid flow is provided that directs fluid so that it exits the nose segment and contacts the surface from which the particulate matter is being dislodged. A nozzle assembly is provided within and extends along the nose segment. The nozzle assembly is operatively connected to the high-pressure airflow assembly and emits the fluid therefrom. The nozzle assembly may include multiple nozzles that are spaced from each other and configured to emit the fluid as a series of discrete pulses, for example in an manner such that each of the multiple nozzles defines a blast diameter upon the surface from which the particulate matter is being dislodged. In so doing, a cumulative blast pattern is defined by the combined blast diameters of the multiple nozzles. The cumulative blast pattern may define a coverage area that corresponds in size to an area value of a downwardly facing area of the nose segment.

In one embodiment, the blast pattern coverage area is at least as large as the downwardly facing area of the nose segment.

In another embodiment, the blast diameters of the multiple nozzles overlap each other so as to define a blast pattern that is continuous along a length or width of the coverage area.

In yet another embodiment, the high-pressure airflow assembly further includes a rotary valve discretely delivering volumes of fluid to the multiple nozzles. The rotary valve can further include a rotating component that extends axially into the inner sleeve and is supported by a support shaft that accepts pressurized fluid from the high-pressure assembly. The rotating component may be rotated by a gear-train that is driven by a prime mover. The gear-train may also drive at least one other component in addition to the rotating component.

In some embodiments, the nozzles emit the fluid as a series of discrete pulses in a manner that simulates a square wave as represented in a corresponding pressure versus time plot.

In yet other embodiments, the rotary valve further comprises an inner sleeve that is provided concentrically inside of and supporting a manifold sleeve.

According to another embodiment of the present invention, a device is presented for dislodging and capturing particulate matter that has accumulated on various surfaces or structures. Low and high pressures systems of the device create opposing airflows that can intimately interface with each other during use. From the low-pressure system, a vacuum airflow is drawn into the device, defining a vacuum affected zone upon the surface being cleaned. It is noted that the vacuum airflow not only affects such a surface but also acts upon a three-dimensional air space defined generally between the device and the surface being cleaned, e.g., removing airborne particulates therefrom. From the high-pressure system, a high-pressure airflow is emitted that penetrates through the opposing vacuum airflow and contacts the surface being cleaned, dislodging particulate matter therefrom. Optionally, the high-pressure airflow does not penetrate the vacuum airflow but rather flows closely adjacent thereto or even intimately interfacing therewith, preferably in substantially opposing directions. The high-pressure airflow can be emitted from multiple nozzles as a series of airflow bursts that discretely contact the surface being cleaned. The (i) configuration of each nozzle, (ii) overall arrangement and position(s) of all the nozzles together, (iii) particular firing or discharge sequence of the multiple nozzles, and (iv) duration and power or amplitude of each high pressure airflow burst, are selected to impart the desired particulate matter dislodging characteristics to the device. Additionally, outlets and/or inlets of the low-pressure system are preferably sized and configured to optimize capturing performance of particulate matter.

In another embodiment, the device includes a handle and a nose segment extending away from the handle. A vacuum airflow enters nose segment and defines a vacuum affected zone on the surface being cleaned. A high-pressure airflow exits the nose segment and penetrates through or flows adjacent to the vacuum airflow, contacting the surface to be cleaned. In this configuration, the high-pressure airflow dislodges at least some of the particulate matter from the surface to be cleaned, which is then captured by the vacuum airflow. In this regard, the device can perform non-contact particulate matter removal from the surface being cleaned.

In some embodiments, the high-pressure airflow is emitted from a nozzle at a supersonic velocity.

In another embodiment, the high-pressure airflow is emitted as a series of discrete pulses. The discrete pulses can be emitted from multiple high-pressure nozzles that are spaced from each other, along a length dimension of the nose segment, or otherwise.

In yet another embodiment, the device weighs less than 5 pounds, and preferably less than about 2 pounds.

In some embodiments, the device includes at least one accessory for mechanically dislodging particulate matter from the surface being cleaned. Such accessory can be a squeegee, disposable and/or dust removal cloth, a brush, or other accessory.

In yet other embodiments, the device includes (i) at least one primary vacuum inlet port that defines a passage for the vacuum airflow entering the nose, and (ii) at least one auxiliary vacuum inlet port that is spaced or removed from the primary vacuum inlet port. The auxiliary vacuum inlet port can be used to collect relatively large debris such as, e.g., large crumbs. The vacuum inlet can be provided on a handle assembly, main body segment, or nose segment of the device. When provided on a nose segment, the auxiliary vacuum inlet can be utilized by, e.g., actuating a movable or removable portion, such as a cover or shroud, of the nose segment.

In another embodiment, a low-pressure airflow is emitted from the nose segment. The low-pressure airflow at least partially contains the vacuum airflow and/or the high-pressure airflow and therefore also influences the vacuum affected zone on the surface to be cleaned. Preferably, a user of the device can control or vary the velocity of such low-pressure airflow emitted from the nose segment, or stop and start the emission of the low-pressure airflow from the nose segment, as desired.

In yet another embodiment, the low-pressure emitted airflow also includes a chemical cleaning agent and/or a scented substance.

In yet another embodiment, the device includes an auxiliary high-pressure nozzle that allows a user to select a targeted high-pressure airflow. The auxiliary high-pressure nozzle does not have to penetrate through the vacuum airflow, but rather can flow from an end of the nose segment, facilitating the user's ability to aim the auxiliary high-pressure airflow, e.g., pulses. This can prove particularly beneficial when removing particulate matter that is upon a surface that is perpendicular to a plane defined by the primary high-pressure nozzles, or particulate matter that is confined in spaces that restrict the user's ability to suitably align the primary high-pressure nozzles for removal.

In some embodiments, the device has visual indicators that show the locations of the high-pressure nozzles. For example, visual indicators are provided on an upper surface or elsewhere on the nose segment or body of the device. The visual indicators can be written, printed, or other indicia such as over molding protrusions or depressions in an upper surface of the nose segment.

In another embodiment, the visual indicator is light emitted from the nose by, e.g., a light emitting diode (LED) or other suitable source of illumination.

In still another embodiment, the invention includes a method of touchless particulate matter removal using a handheld portable device. During use, a vacuum airflow is drawn into the device away from a surface being cleaned that has accumulated particulate matter thereon. A high-pressure airflow exits the device and flows through the vacuum airflow, dislodging at least some of the particulate matter from the surface being cleaned. At least some of the dislodged particulate matter becomes entrained into the vacuum airflow, whereby at least some of the particulate matter is removed from the surface and collected by the device without any surface contact.

In another embodiment, the device has a balanced and ergonomic handle having a top mounted ON/OFF switch.

In one exemplary embodiment, the device is generally composed of a handle assembly, a body assembly, and a nozzle assembly. The body assembly includes a curved housing that effectively defines a curved flow between the body assembly and the nozzle assembly. A low-pressure fan is mounted to a bottom surface of the curved housing and in fluid communication with the curved flow. A high-pressure rotary valve is mounted to a forward portion of the body assembly and is adapted to inject air into the nozzle assembly. In one embodiment, the fan and the rotary valve are powered by a shared motor. In yet a further embodiment, compressed air is fed to the rotary valve by a compressor, which is also driven by the motor. In one embodiment, the motor is a brushed DC motor with a rated voltage of 20 VDC and rated current of 8 amps. At a distal end of the handle assembly is a housing for holding a battery pack, which in a preferred embodiment, is a set of rechargeable batteries. In a further embodiment, the housing has electrodes that are connected to the battery pack when the battery pack is loaded into the housing to allow the batteries to be charged when the device is seated in a suitable cradle. Preferably, a fully charged battery pack will permit approximately 15 minutes of continuous operation. In one embodiment, the battery pack has a nominal voltage of 12VDC with a current draw of 4.5 amps.

In an exemplary embodiment, a thermoformed filter is disposed in the body assembly and is secured in the body assembly by a see-through cap. The clear cap allows a user to determine when the filter should be replaced or cleaned without removal of the cap.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which.

Figure 1:
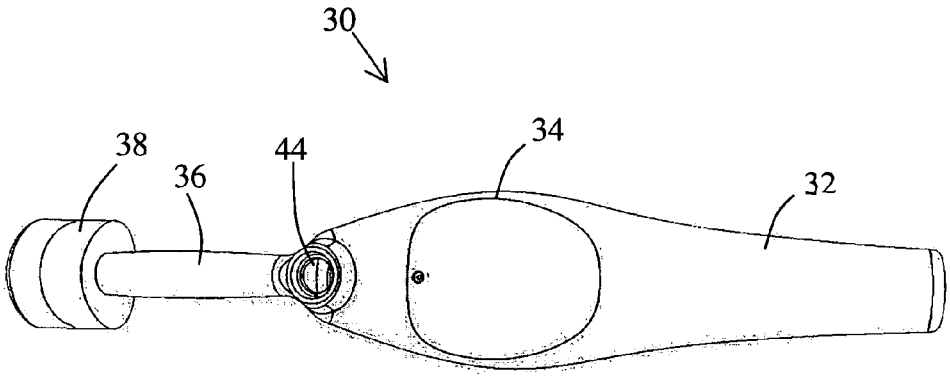
FIG. 1 is a top view of a handheld portable device for touchless particulate matter removal according to one embodiment of the present invention.

In describing the preferred embodiments of the invention that are illustrated in the drawings, specific terminology will be resorted to for the sake of clarity. However, it is not intended that the invention be limited to the specific terms so selected and it is to be understood that each specific term includes all technical equivalents, which operate in a similar manner to accomplish a similar purpose. For example, the words "connected", "attached", or terms similar thereto are used. However, they are not limited to direct connection but include connection through other elements where such connection is recognized by those skilled in the art.

DETAILED DESCRIPTION OF THE INVENTION

The present invention and the various features and advantageous details thereof are explained more fully with reference to the non-limiting embodiments described in detail in the following description.

A. System Overview

Figure 2:
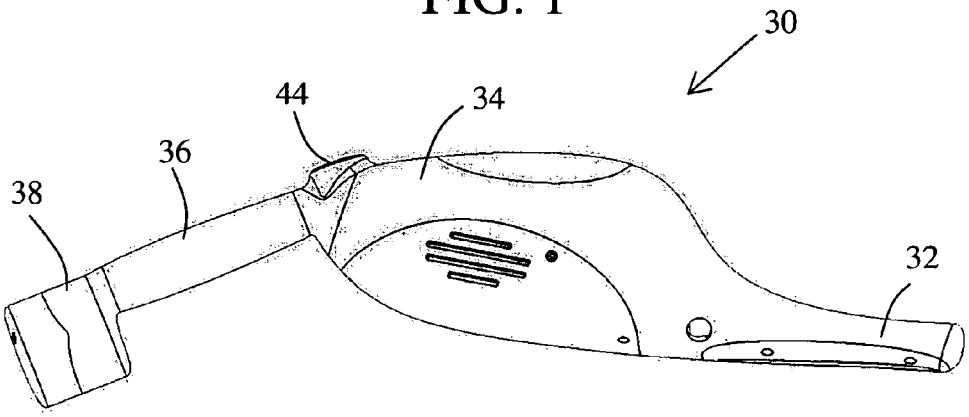
FIG. 2 is a side elevation view of the handheld portable device shown in FIG. 1.
Figure 3:
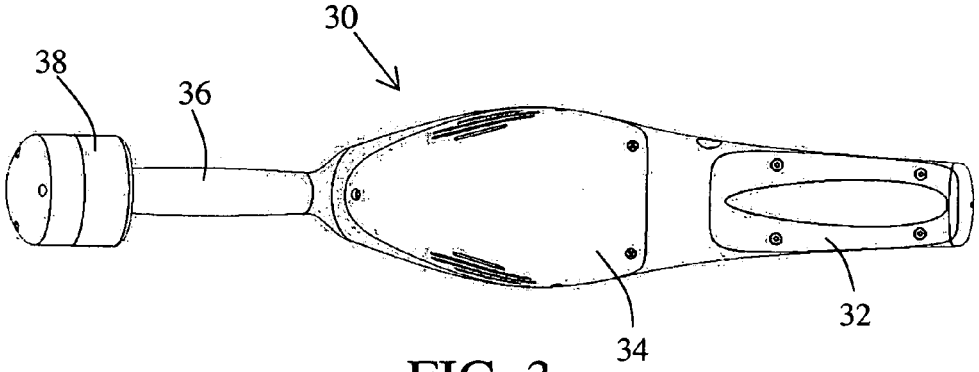
FIG. 3 is a bottom plan view of the handheld portable device shown in FIGS. 1 and 2.

Referring now to FIGS. 1-3, the invention is directed to a portable device which can be configured as a handheld portable device or otherwise configured, based on the particular desired end use configuration. Illustrated is an example of various handheld versions of the device 30 for touchless or non-contact particulate matter removal. The device 30 is generally comprised of a nose segment 32, a body segment 34, and a handle segment 36.

Figure 4:
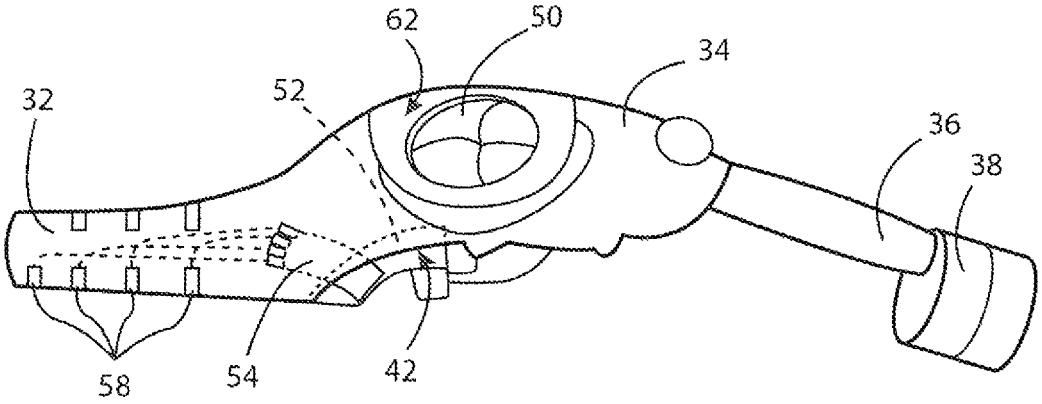
FIG. 4 is a top isometric view of the handheld portable device shown in FIGS. 1-3 with selected portions of the device shown in phantom and hidden to expose internal components of the handheld portable device.
Figure 5:
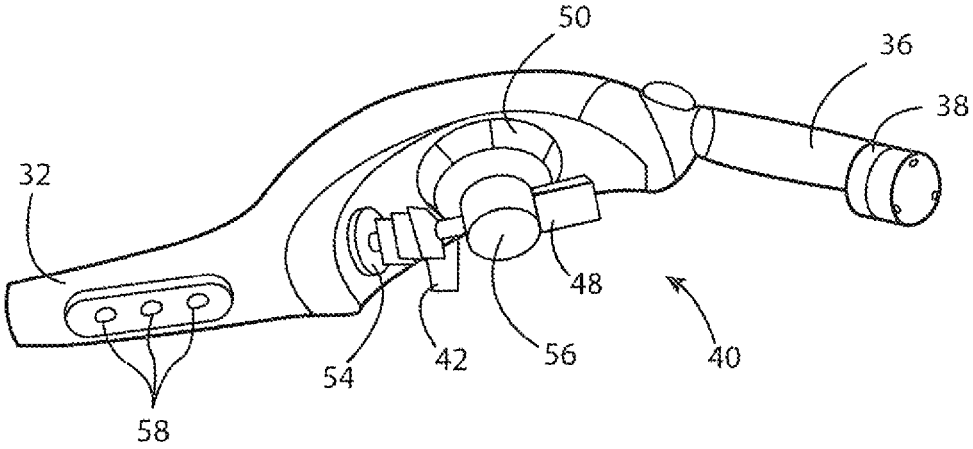
FIG. 5 is a bottom isometric view, similar to that of FIG. 4, of the handheld portable device of FIGS. 1-3-.

With additional reference to FIGS. 4 and 5, the device 30 is configured for performing dust removal or other particulate matter removal type cleaning tasks, without ever touching the substrate of the surface being cleaned. To provide such touchless particulate matter removal, device 30 preferably includes a low-pressure system 40 and a high-pressure system 42 which cooperate with each other to pneumatically remove particulate matter from the surface being cleaned. In typical embodiments, the low-pressure system 40 uses one or more low-pressure airflow components, for example, a high volume low-pressure airflow component, for capturing, retaining, and removing particulate matter.

The low pressure system 40 may also include a positive pressure or output airflow component that can be used to at least partially laterally restrain the various airflows of the pneumatic particulate matter removal phenomenon of device 30, whereby a low pressure output airflow component serves as, e.g., an air curtain. The air curtain can be defined by a high volume low-pressure airflow that is emitted from the device 30, which can at least partially pneumatically confine various other airflows of the device 30. Preferably, if an air curtain is incorporated into the low-pressure system 40, its flow rate is adjustable or can be turned off entirely, if desired. In one embodiment, the air curtain is altogether absent.

It will thus be appreciated that the low-pressure system 40 is configured to pull loosely settled or airborne particulate matter into the device 30, without requiring the device 30 to touch the surface or substrate being cleaned. However, it is noted that in many cleaning situations, for example, while performing various household dusting tasks, at least some particulate matter will be stuck, clung, lodged, or adhered to a surface to at least a modest extent. In these situations, the low-pressure system 40 may experience difficulties in removing such particulate matter, whereby high-pressure system 42 can then be fully appreciated.

The high-pressure system 42 is configured to dislodge particulate matter that is stuck, clung, lodged, or adhered to a surface being cleaned by outputting a high-pressure airflow from device 30. For example, the high-pressure system 42 pneumatically overwhelms the attractive forces between the particulate matter and the substrate or surface, be it electrostatic, adhesive, mechanical, or otherwise. Preferably, high-pressure system 42 does so by delivering high-pressure airflow in discrete pulses; although the invention is not limited to a pulsed airflow. These pulses can be delivered at high velocities, for example, supersonic velocities. Correspondingly, the pneumatic airflow of high pressure system 42 loosens the particulate matter or renders it airborne, in either regard making the particulate matter more susceptible to the vacuum influences of low pressure system 40. Stated another way, the high-pressure system 42 drives or dislodges the particulate matter and the low-pressure system 40 removes and captures the particulate matter.

During most uses, the low and high-pressure systems 40 and 42 are used concurrently. This allows the dislodging, removal, and capturing of particulate matter to occur in a generally simultaneous and continuous manner. However, as desired, a user can enable or disable certain airflow components of either or both of the low and high-pressure systems 40 and 42. When only dislodging capabilities are desired, or if it is otherwise desired to not establish opposing airflows, the user can turn off the low pressure system 40, and/or direct the resources of device 30 to fewer than all components of the high pressure system 42, described in greater details elsewhere herein. Correspondingly, when only capturing capabilities are desired, or if it is otherwise desired to not establish opposing airflows, the user can turn off the high pressure system 42, and/or direct the resources of device 30 to fewer than all components of the low pressure system 40, described in greater details elsewhere herein.

The versatility of the low and high-pressure systems 40 and 42, along with the compact and easily portably configuration of the device 30, make it suitable for numerous end-use applications. Exemplary of such end-use applications include, but are not limited to: household dust removal, other household particulate matter removal, automotive interior dust removal, other automotive interior particulate matter removal, automotive exterior dust removal, other automotive exterior particulate matter removal, commercial/industrial dust removal, other commercial/industrial particulate matter removal, and/or others. It is further noted that the device 30 is not restricted to particulate matter removal from hard or other surfaces that are typically dusted with conventional dusting products, but also is useful for numerous other surfaces and substrates in which particulate matter redeposition occurs. For example, it will be appreciated that the device 30 can be used for particulate matter removal or other types of soft-surface remediation for, e.g., upholstery, cloth and other lamp shades, draperies and valances, various collectables and/or other delicate or intricately cared-for items, as well as items with e.g., sharp protrusions or other physical characteristics that make them ill-suited for conventional cloth or other contact-style dust removal.

B. Detailed Description of Preferred Embodiments

Specific embodiments of the present invention will now be further described by the following, non-limiting examples which will serve to illustrate various features of significance. The examples are intended merely to facilitate an understanding of ways in which the present invention may be practiced and to further enable those of skill in the art to practice the present invention. Accordingly, the examples discussed herein should not be construed as limiting the scope of the present invention.

1. Overview of Device Components and System Architecture

Referring now to FIGS. 1-5, one preferred embodiment is shown. In this embodiment, the handle segment 36 provides the primary user interface for operating the device 30. A switch 44, which is preferably a conventional on/off trigger style switch, is provided such that when a user actuates the switch 44, the device 30 is energized. Upon releasing switch 44, the device 30 is de-energized. The handle segment further provides a battery compartment 38 for housing one or more batteries 46 therein, which in one embodiment is a rechargeable battery pack.

The body segment 34 provides a housing for the low and high-pressure systems 40 and 42. Exemplary of such moving and/or heat generating components of the low and high-pressure systems 40 and 42 include a high speed or other DC, optionally AC, electric motor 48, a low-pressure fan 50, a high-pressure compressor 52, and a high-pressure rotary valve 54.

Figure 24:
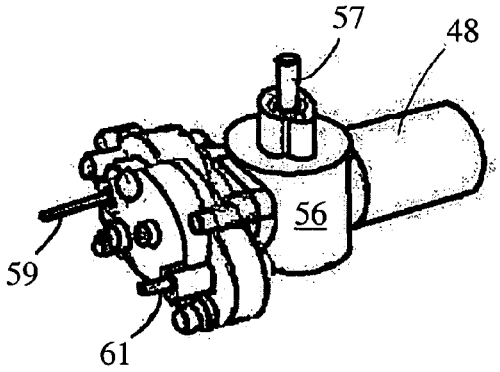
FIG. 24 is an isometric view of a spur gear box assembly of the handheld portable device shown in FIGS. 1-5.
Figure 25:
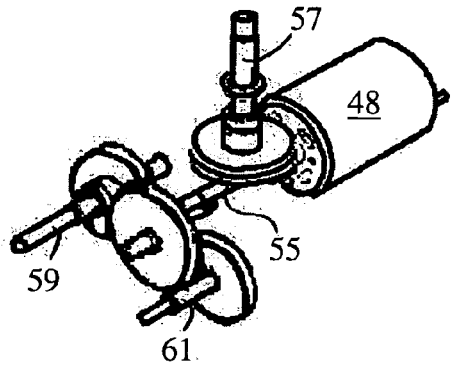
FIG. 25 is a partial exploded view of the spur gear box assembly shown in FIG. 24.
Figure 26:
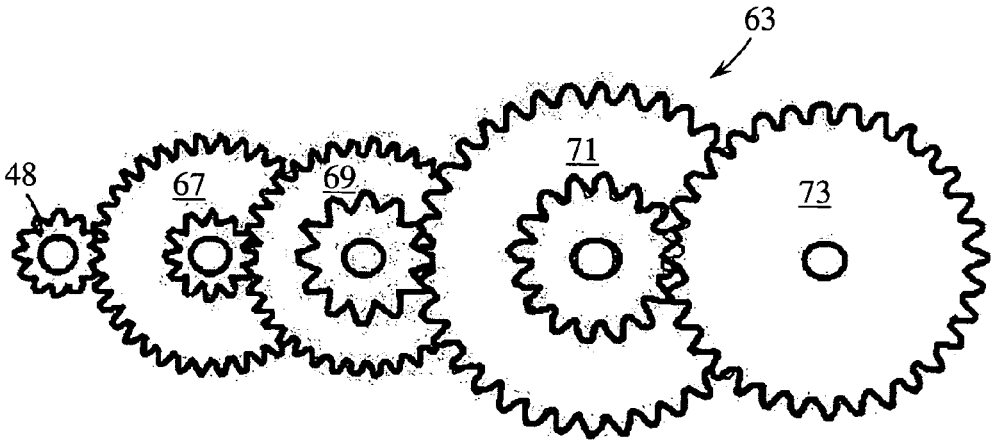
FIG. 26 is a simplified gear layout of the gears of the spur gear box assembly shown in FIGS. 24 and 25.

Referring briefly to FIGS. 24-26, the motor 48 either directly drives the low-pressure fan 50, or, more preferably, drives an input shaft 55 of a gearbox 56. The gearbox 56 preferably has three output shafts. A first output shaft 57 of gearbox 56 rotates the low-pressure fan 50 and a second output shaft 59 of gearbox 56 rotates, e.g., an input shaft of the high-pressure compressor 52. A third output shaft 61 operably connects motor 48 to the high-pressure rotary valve 54. In other words, the gearbox 56 preferably splits the power provided by motor 48, whereby a single motor 48 can drive (i) the low-pressure fan 50, (ii) the high-pressure compressor 52, and (iii) the rotary valve 54. The gear box 56 has an arrangement of gears, shown collectively at FIG. 26, for interfacing with the motor 48, the compressor 54, and the rotary valve 56. More particularly, the gear layout 63 includes a ring gear 65 that is driven by the motor 48, an idler ring gear 67, a compressor ring gear 69, another idler ring gear 71, and a valve ring gear 73. While it is preferred that a single motor drives the compressor, the rotary valve, and the fan, it is contemplated that separate motors could be used or one of the aforementioned mechanical devices could be driven by a separate motor and the other mechanicals driven by a shared motor.

The nose segment 32 is generally an elongate, generally hollow, member that is sized and configured based at least in part on the configuration of cooperating components, as well as the intended end use of device 30. Preferably, the nose segment 32 is about 3 to 8 inches long, more preferably about 5 to 7 inches long, and defines rather narrow width and height dimensions, e.g., less than about 3 inches, optionally less than about 2 inches, and relatively small cross sectional area. As one example of a suitable cross sectional area, the nose can taper down from a relatively larger 2-inch by 2-inch area adjacent the main body segment 34 to a relatively smaller 1-inch by 1-inch area at its end portion. Regardless of the particular dimensions, the nose segment 32 is configured to provide a long swath or path allowing for quick dusting, yet is slender enough to easily traverse between or through closely arranged articles or spaces while reducing the likelihood of inadvertently bumping such articles. It is contemplated however that the length of the nose segment 32 can be less than its width.

The nose segment 32 houses at least portions of various ducting structure(s) that direct the various airflow components into or out of the device. Exemplary airflow component directing structures include vacuum inlets 58 and high-pressure nozzles 60 of the low and high-pressure systems 40 and 42, respectively. By housing all of the primary inlets and outlets such as the vacuum inlets 58 and high pressure nozzles 60 within the nose segment 32, device 30 is able to generally concentrate both airflow inputs and outputs of the low and high pressure systems 40 and 42 onto a surface area, or affected zone, of the surface being cleaned.

Figure 6:
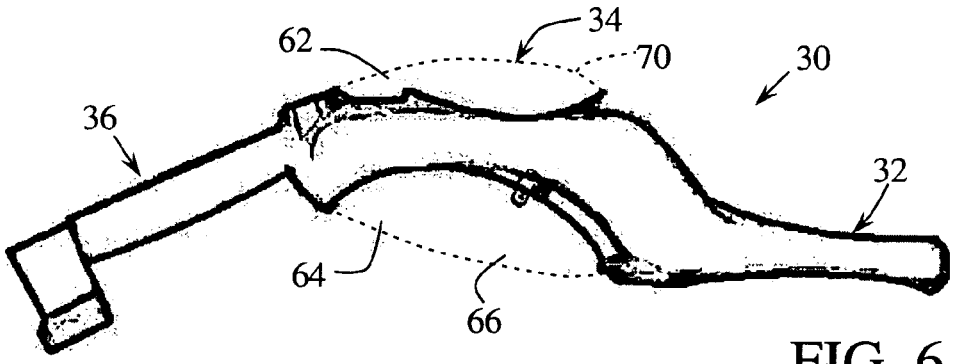
FIG. 6 is a side elevation view of a housing portion of the handheld portable device shown in FIGS. 1-5.

As shown in FIGS. 5 and 6, the main body segment 34 is generally curved. As will be explained in greater detail herein, this curvature provides a curved flow path from the nose segment 32 to a residue collection chamber 62 that is positioned generally above the fan 50 and into which a filter (not shown) is preferably loaded for the collection of dust and other residue captured by the vacuum nozzles 60.

Figure 7:
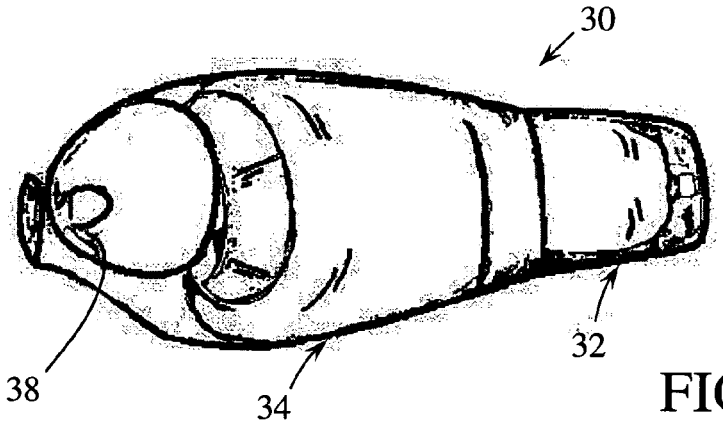
FIG. 7 is a bottom view of the housing portion shown in FIG. 6.
Figure 8:
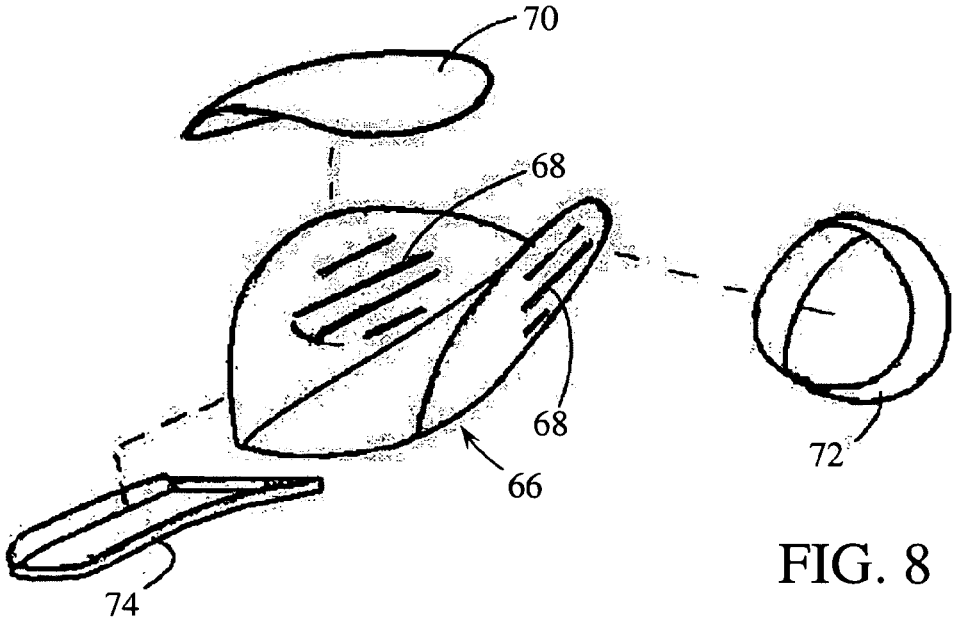
FIG. 8 is a collection of isometric views of additional components of the handheld portable device that interface with the housing portion shown in FIGS. 6 and 7.

Turning to FIGS. 6-8, the main body segment 34 and the nose segment 32 are preferably formed as a single body; although, the invention is not so limited. The handle segment 36 is preferably affixed to the main body segment 34 in a conventional manner but it is understood that the handle segment 36 could also be integrally formed with the body segment 34 and the nose segment 32. In some embodiments, the handle segment 36 is hinged in some manner to the main body segment 34 to allow the device to effectively fold or bend which can be advantageous for dusting difficult to reach horizontal surfaces, such as relatively high shelves. The orientation of the nose segment 32 and the handle segment 36 relative to the main body segment 34 is particularly well illustrated in FIG. 6. As will be described, a flow path is defined from within the nose segment 32 to the main body segment 34 and, in particularly, to the residue chamber 62. The motor 48, gear box 42, compressor 52 are contained within a mechanicals enclosure 64 that is defined in a lower portion of the main body segment 34. The mechanicals enclosure 64 is closed by a removable cover 66, which is shown in FIG. 8 to have a generally saddle-like shape. The cover 66 includes vents 68, the significance of which will be described hereinafter.

Also shown in FIG. 8 is a filter cover 70 that is preferably made of a clear plastic material and closes the residue chamber 62. Still referring to FIG. 8, in a preferred construction, battery cap 72 interfaces with the battery pack chamber 38 to secure a battery pack or set of batteries into the chamber 38. In addition, a wand cover 74 interfaces with the nose segment 32 to generally close access to the working components of the nose segment 32, such as rotary valve 54.

2. Low-Pressure System Generally

The low-pressure system 40 operates as a function of the low-pressure fan 50 that is preferably driven by the subassembly of motor 48 and gearbox 56. As shown in FIGS. 12-16, low-pressure fan 50 includes multiple rotating blades 76 that radiate from a shaft 78 that is preferably arranged vertically within the main body segment 34. The particular configuration of fan 50 is selected based on the intended end use implementation(s) of device 30, whereby fan 50 can be any of a variety of suitable designs such as, e.g., radial fans, axial fans, mixed flow fans, squirrel cage fans, and/or others. Preferably, fan 50 defines a flow rate of about 10-40 Cubic Feet per Minute (CFM), or preferably about 25-30 CFM, and is capable of establishing air pressure of about 1-10 inches of water column.

Fan 50 is an impeller that is preferably configured to draw in or intake air in along an axial path, yet discharge air in an airflow having both a radial and an axial component. To accomplish this mixed-flow discharge functionality, fan 50 includes a first and a second tapering members, e.g., tapered hub 80 and tapered outer shell 82 that are axially spaced from each other, noting that tapered hub 80 can extend or be nested somewhat within the tapered outer shell 82.

The tapered hub and outer shell 80 and 82 each defines an outer surface that is generally frusto-conical. Preferably, the frusto-conical outer surface of tapered hub 80 converges or tapers downwardly at a steeper or greater angle than does that of the tapered outer shell 82. In this regard, the width of the void space between the inner surface of the tapered outer shell 82 and the outer surface of hub 80 decreases while traversing from the outer shell 82 to the hub 80. Multiple fins 84 extend radially between the tapered hub 80 and outer shell 82. The fins 84 also extend angularly with respect to an axis of rotation of the fan 50, and can, in some implementations, have one or more curves or sharp-angle bends along their respective lengths.

The rearmost portions of the tapered hub 80 and shell 82, spaced from each other by fins 84, define openings 86 therebetween. It is through the openings 86 that the mixed-flow, e.g., combined axial and radial flow, airflow exits the fan 50.

Referring again to FIGS. 4-5, the intake side of fan 50 is utilized for providing a negative or vacuum pressure for the device 30. The intake or vacuum side of low pressure fan 50 is fluidly connected to one or more openings or primary vacuum inlets 58, and optionally, an auxiliary inlet (not shown), provided in nose segment 32. The particular portion (s) of nose segment 32 that draw in a vacuum airflow are selected based on the intended end use characteristics of device 30. Accordingly, the vacuum airflow can be drawn through, e.g., a portion or the entire length of the lower portion of nose segment 32, and/or elsewhere through nose segment 32 such as one or more sidewall portions thereof.

Accordingly, the particular location(s), shape(s), and dimension(s) of the primary vacuum inlets 58 are selected based at least in part on the portion of nose segment 32 in which they are installed. For example, in typical implementations, vacuum inlets 58 are provided on a downwardly facing surface of nose segment 32. The vacuum inlets 58 preferably occupy a major portion of the downwardly facing surface area, and more preferably occupy substantially all of the downwardly facing surface area. It is noted that the vacuum inlets 58 can be multiple, discrete openings in the downwardly facing surface of nose segment 32, or can be defined by a single, unitary elongate opening therethrough. A single vacuum inlet whose width increases with distance from the fan has been found to be particularly advantageous as such an inlet maintains more consistent vacuum suction along the full length of the opening.

As noted above, in some embodiments, the vacuum airflow can be drawn through the primary vacuum inlets 58, or an auxiliary vacuum inlet (not shown), as desired. It is therefore contemplated that the auxiliary vacuum inlet can be covered by a shroud (not shown), whereby it is disengaged, in a default position. When the auxiliary vacuum inlet is to be utilized, the shroud is slid longitudinally away from the vacuum inlet effectively exposing the auxiliary inlet and directing the vacuum airflow therethrough.

As noted above, the fan 50 sits beneath a residue chamber 62, which is normally loaded with a filter. In this regard, the filter (not shown) sits between the nose segment 32 and the inlet or vacuum side of low-pressure fan 50. In this configuration, as low pressure fan 50 draws a vacuum airflow through nose segment 32, that vacuum airflow is filtered by way of the filter before passing through the low pressure fan 50, capturing particulate matter which was removed by the device 30.

As noted above, preferably, the residue chamber 62 is covered by a clear, transparent, or translucent lid or cover 70 enabling a user to quickly determine whether the filter has been sufficiently soiled to justify replacement. Optionally, a filter fullness indicator can be provided on the device 30, visually showing a user when the filter assembly 50 or its filtering material should be replaced. The filtering material of the filter is selected on the intended end use environment, and includes HEPA filters, matted and fiber filters, open cell foam filters other nonwoven fiber filters, corrugated filters, tacky substance covered filters, electrostatically charged filters, and/or others, as desired. It is further noted that the particular type and number of filtering elements and location of such elements utilized in the filter corresponds to the intended end use of device 30. In other words, in some embodiments, the filter is durable and washable whilst in other preferred embodiments the filter is disposable and replaceable. Furthermore, the filter material or media of the filter can be treated with a scent or disinfecting agent for treating, e.g., a low pressure exhaust airflow.

Preferably, the filtered vacuum airflow enters the intake or vacuum side of low pressure fan 50, passes through the fan 50, and is vented to atmosphere through vent openings 68 formed in cover 66; although, other types of venting arrangements are contemplated and may be used. As the airflow passes from the fan 50 to the vent openings 68, a portion of the airflow also provides cooling of the motor, compressor, and gearbox.

It is further contemplated that the airflow may be treated with, e.g., a scented, odor eliminating, cleaning, or disinfecting substance as it exits the device. This allows a user to clean particulate matter from surfaces or articles while simultaneously improving any malodors nearby.

Alternately, the filtered, positive pressure exhaust airflow from low pressure fan 50 is directed, through suitable ducting (not shown), back through the nose segment 32, exiting as an air curtain type airflow. Preferably the vacuum airflow entering the low-pressure side and the exhaust airflow of the positive pressure side of low-pressure fan 50 traverse the nose segment 32 and other portions of device 30 as completely distinct airflow segments. Thus, ducting and/or other separating structure(s) keep the vacuum and exhaust low-pressure airflows sealed from each other, whereby such opposing airflows only communicate with each other while entering and exiting, respectively, the nose segment 32. Stated another way, of the low-pressure system 40, only the low-pressure airflows outside of device 30 and adjacent the airflow affected portion of the surface being cleaned, namely, the vacuum airflow and the air curtain, would intimately interface and interact with each other in this alternate embodiment. It will be appreciated that the air curtain could be used to not only contain particulate matter, but also in some instances be used to assist with dislodging of particulate matter from a surface. For example, a chemical cleaning agent designed to dislodge particulate matter from the surface could be presented to the surface via the air curtain.

3. High-Pressure System Generally

The high-pressure system 42 operates as a function of the high-pressure compressor 52 that is preferably driven by the subassembly of motor 48 and gearbox 56. In an alternate embodiment, high-pressure air is supplied by a replaceable compressed air container. The high-pressure system 42 includes high-pressure compressor 52, high-pressure rotary valve 54, one or more high-pressure nozzles 60, and optionally an auxiliary high-pressure nozzle (not shown). In some embodiments, a single elongated high pressure nozzle is used, while in other embodiment, a series of spaced nozzles are used.

Turning again to FIGS. 4 and 5, high-pressure compressor 52 is a pump to compress a charge of air that is outputted at a high pressure. Suitable pumps for creating a high-pressure output include a variety of single cylinders, e.g., wobble piston, pumps, and others, as desired. Preferably, high-pressure compressor 52 can operate within a pressure range of about 10-50 psi. The high-pressure airflow outputted from high-pressure compressor 52 is directed to the rotary valve 54. Rotary valve 54 meters and periodically releases bursts of high-pressure air individually to the individual high-pressure nozzles 60 by way of suitable tubing, airlines, or other conduits. Stated another way, the high-pressure compressor 52 and rotary, e.g., distribution, valve 54 cooperate with the high-pressure nozzles 60 to establish and deliver bursts of high-pressure air to the affected zone of the surface being cleaned.

Referring now to FIGS. 17-23, the rotary valve 54 can include a rotating component 88 that extends into an inner sleeve 90. The inner sleeve 90 is retained within a manifold sleeve 92, which in turn fits within an outer sleeve 94. The rotating component 88 interfaces with a support shaft 96 that is driven by gearbox 56. The rotary valve 54 is secured to the gearbox 56 by retaining rings 98. During use, slots in the rotating component 88 align with openings 100 in the manifold 92, permitting the highly pressurized air to pass from the compressor 52 to the manifold 92 via inlet 102 and then to openings 100, and then through fittings that are connected to tubing or airlines leading to the nozzles 60. Thus, the configuration of high-pressure distribution valve 54 influences the pulse characteristics of the airflow bursts that are directed to and through the nozzles 60.

The rotary valve 54 and nozzles 60 cooperate to release airflow bursts that are very abrupt, mimicking the instantaneous delivery of fast-on and fast-off systems, while still providing sufficient flow volume of air to dislodge the particulate matter.

The sharp, discrete bursts provided by high-pressure distribution valve 54 (i) conserve power consumption of device 30, (ii) consume relatively less Cubic Feet per Minute (CFM) of air, and (iii) can be more effective at dislodging stuck particulate matter, as the bursts are emitted from the high pressure nozzles 60 in a manner that simulates a square wave in its pressure versus time plot. Preferably, nozzles 60 are supersonic nozzles, whereby they are configured to accelerate the bursts of airflow to supersonic velocities. It is understood, however, that non-supersonic nozzles could also be used.

Figure 9:
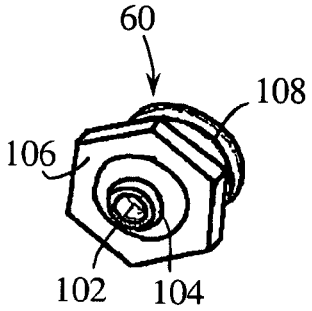
FIG. 9 is an isometric view of a nozzle for use with the handheld portable device shown in FIGS. 1-5.
Figure 10:
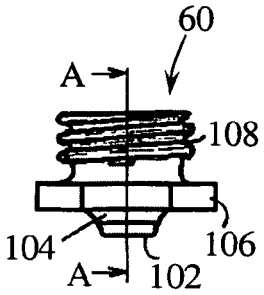
FIG. 10 is a side elevation view of the nozzle shown in FIG. 9.
Figure 11:
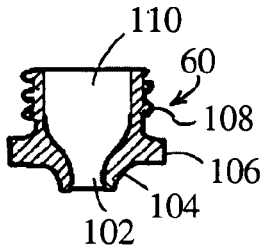
FIG. 11 is a section view of the nozzle shown in FIGS. 9 and 10 taken along line A-A of FIG. 10.
Figure 12:
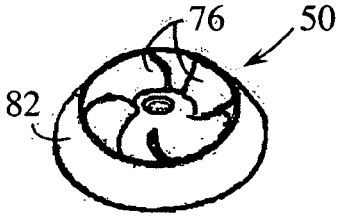
FIGS. 12-16 are several views of a fan for use with the handheld portable device shown in FIGS. 1-5.
Figure 13:
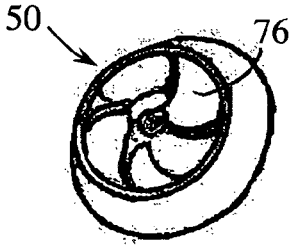
Figure 14:
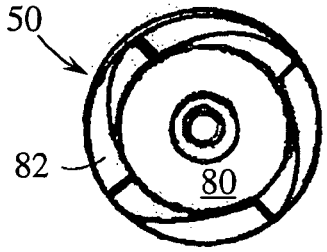
Figure 15:
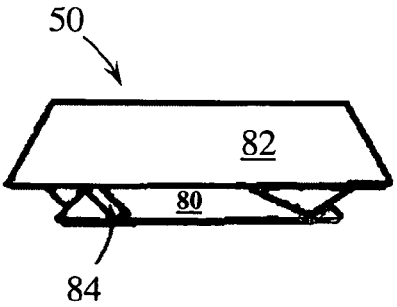
Figure 16:
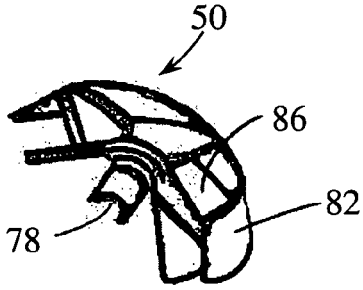
Figure 17:
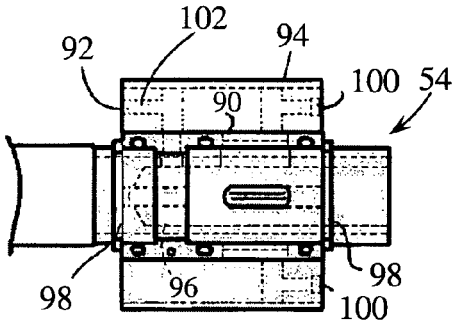
FIG. 17 is a schematic layout of a rotary valve assembly for used with the handheld portable device shown in FIGS. 1-5.
Figure 18:
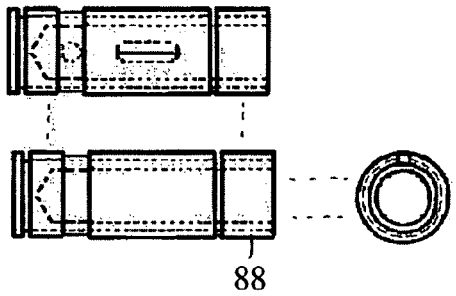
FIG. 18 is a schematic view of a rotating shaft of the rotary valve assembly shown in FIG. 17.
Figure 19:
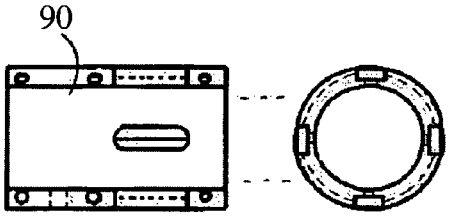
FIG. 19 is a schematic view of an inner sleeve of the rotary valve assembly shown in FIG. 17.
Figure 20:
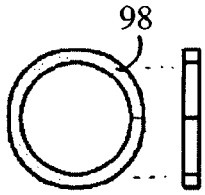
FIG. 20 is a schematic view of a retaining ring of the rotary valve assembly shown in FIG. 17.
Figure 21:
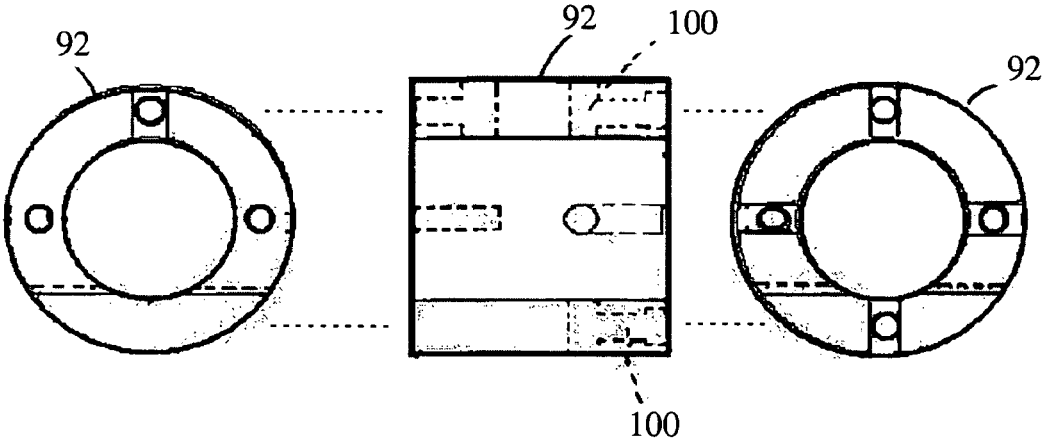
FIG. 21 is a schematic view of a manifold sleeve of the rotary valve assembly shown in FIG. 17.
Figure 22:
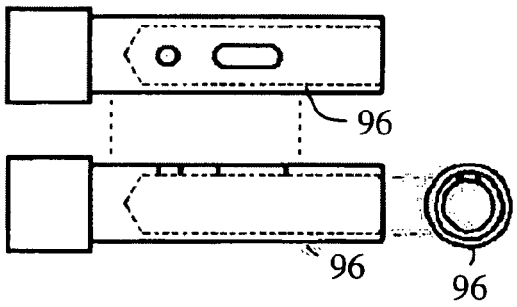
FIG. 22 is a schematic view of a support shaft of the rotary valve assembly shown in FIG. 17.
Figure 23:
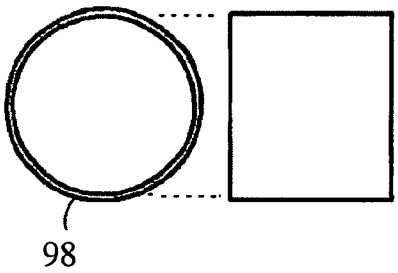
FIG. 23 is a schematic view of an outer sleeve of the rotary valve assembly shown in FIG. 17.

Referring still to FIGS. 9-11, each nozzle 60 has a discharge opening 102 that is defined generally by a frustoconical flange 104 extending from a wall 106. Opposite flange 104 is a threaded body 108 for threadingly connecting the nozzles 60 to corresponding high-pressure conduits in the nose segment 32. The openings 102 are shaped to influence the surface area and shape upon the surface being cleaned and affected by the airflow bursts. Correspondingly, the particular number of nozzles 60, the spacing between them, and their respective orientation and/or arrangements within the nose segment 32, are all selected to provide desired airflow bursts.

Accordingly, the opening perimeter shapes of nozzles 60 and the profile and inside diameter(s) of the axial bores 110 extending therethrough at least partially define blast radii or blast diameters upon the surface being cleaned. The spacing and particular emission sequence and arrangement of the nozzles 60 are configured to provide the desired cumulative blast pattern and corresponding coverage area on the surface being cleaned, be it linear, curvilinear, overlapping, spaced, or otherwise.

4. Power Circuit

Figure 27:
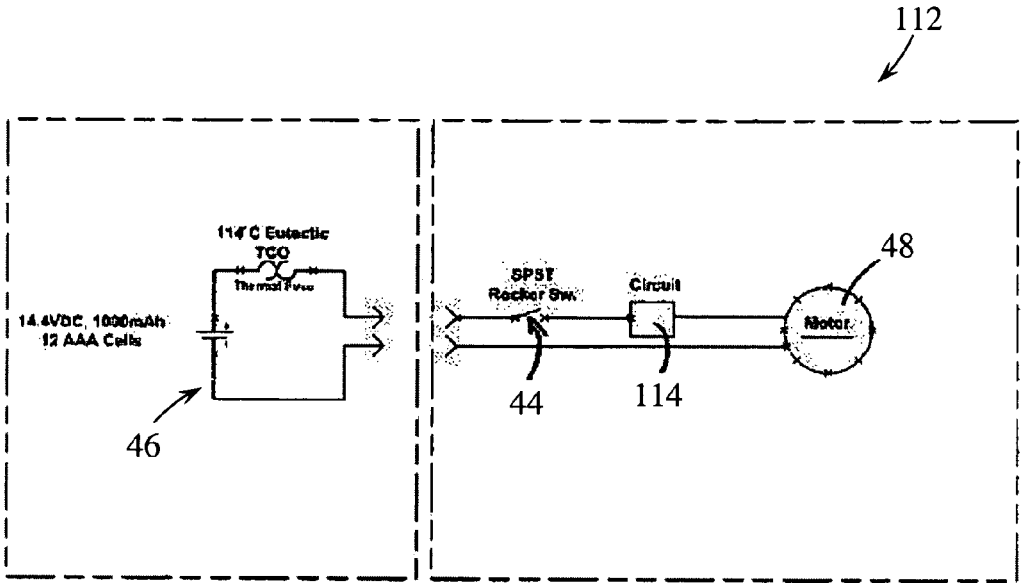
FIG. 27 is a schematic diagram of a power circuit of the handheld portable device shown in FIGS. 1-5.
Figure 28:
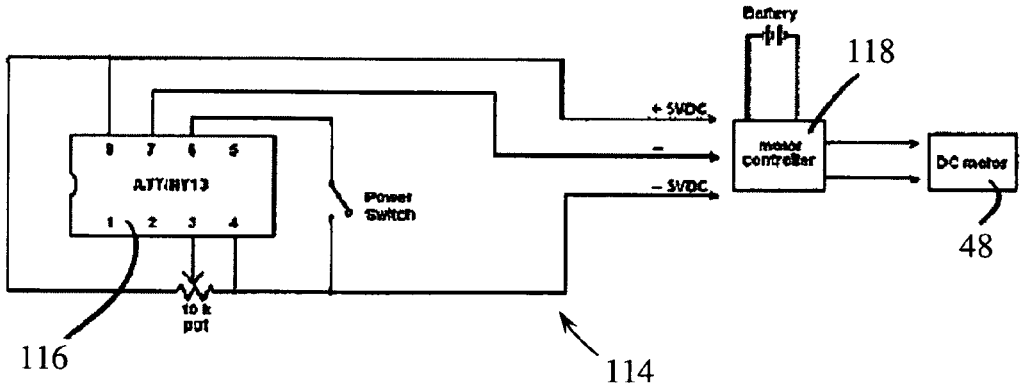
FIG. 28 is a schematic diagram of a ramp up speed control circuit for use with the power circuit shown in FIG. 27.

Turning now to FIGS. 27 and 28, in a preferred embodiment, power is provided to the motor 48, which drives the fan 50, compressor 52, and valve 54, by a battery pack 46. Rocker switch, e.g., pushbutton 44, closes the circuit between the battery pack 46 and the motor 48. That is, when the pushbutton 44 is pressed into the ON position, the circuit is closed and the motor 48 is powered. Conversely, when the pushbutton 44 is pressed into the OFF position, the motor 48 is isolated from the battery pack 46. The power circuit 112 also includes a ramp up speed control circuit 114, which is shown schematically at FIG. 28.

The speed control circuit 114 has a microprocessor 116, or similar intelligence, to provide pulse width modulation control of the motor 48. More particularly, the processor 116 provides suitable controls to the motor controller 118 for controlling motor operation as described herein.

C. System Use

During use, the nose segment 32 is positioned between about 0.5 to 4 inches, optionally about 1 to 3 inches, or preferably about 1 inch, above such surface or article, but regardless, the user need not touch or otherwise contact the device 30 to it. Then, the user actuates the switch 44 and thereby energizes motor 48 which, by way of gearbox 56, low-pressure fan 50 and high-pressure compressor 52, powers the low and high-pressure systems 40 and 42. The user is then able to detach or dislodge and capture or remove dust or other particulate matter in a touchless manner, even from under overhanging structures of objects without having to remove the objects from their resting places to access the under sides of the overhanging structures.

Figure 29:
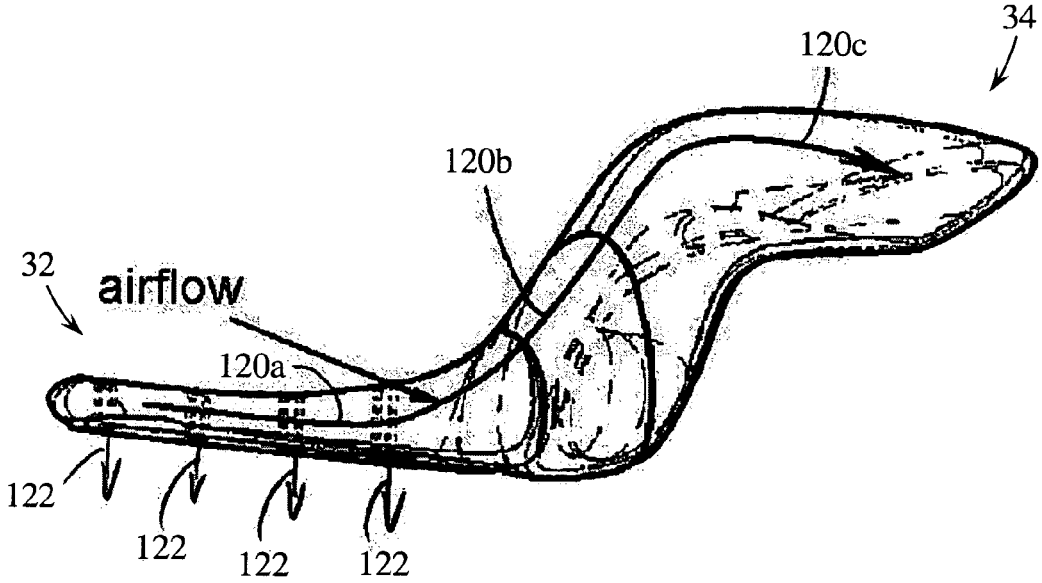
FIG. 29 is a schematic view showing an air flow path defined within the housing of the handheld portable device.

Referring now to FIG. 29, upon so doing, the device 30 establishes a low-pressure vacuum airflow 120 and high-pressure airflow bursts 122. As shown at FIG. 29, the vacuum airflow 120 has a linear component 120*a* in the nose segment 32, a curved component 120*b* defined generally at the interface of the nose segment 32 and the main body segment 30, and a linear component 120*c* defined in the main body segment 34 as the airflow approaches the residue chamber 62 and the filter disposed therein. Since the high-pressure nozzles 60 are positioned, for example, centrally and linearly, within nose segment 32, the high-pressure airflow bursts 122 penetrate through or adjacent the vacuum airflow 120. In this regard, the high-pressure airflow bursts 122 can dislodge at least some of the particulate matter from the surface that is being cleaned, and the vacuum airflow 120 removes the particulate matter and captures it in the filter. This allows the particulate matter to be removed from the surface or article by way of a touchless technique.

In some implementations, an optional low-pressure air curtain output airflow concentrically surrounds the vacuum airflow and defines an outermost disposed airflow for containing the dislodged dust and debris within its perimeter. Regardless, the device 30 removes dust or debris from a surface or object without ever having touched, contacted, or moved such surface or object, relatively reducing the time required for a user to perform various household dust or debris removing tasks. However, some embodiments include at least one accessory for mechanically dislodging particulate matter from a surface being cleaned so that if desired, a user can also use contact-type cleaning techniques in addition to the touchless techniques allowed by the device 30. Such examples include a brush or fluffy duster cloth.

In a preferred embodiment, the device 30 is powered by rechargeable batteries (not shown). In a further embodiment, the batteries take the form of a rechargeable battery pack (not shown) that is contained in a compartment 38 defined at the distal end of the handle segment. By locating the batteries at the distal end of the handle segment, the total weight of the device is advantageously distributed away from the mechanicals so as to keep the center of gravity of the device comfortably over the user's hand. It is contemplated that the compartment 38 may be received by a charging station (not shown) that can be configured as a docking station for holding the device 30 while it charges or recharges. Optionally, the battery pack may be replaced with another battery pack that may be charged at the charging station. In yet other embodiments, the charging station may be an integral component of device 30, whereby it serves as an AC to DC power converter and the device 30 assumes a "corded" configuration. In yet further embodiments, the device 30 is corded but is devoid of an AC to DC power converter, whereby any electronic devices therein are AC powered.

In one preferred embodiment, the handheld portable device has a weight less than equal to two pounds and is operative to capture approximately 70 percent of dust dislodged from a surface. It is understood that greater that 70 percent capture is possible but may require a sacrifice in the overall size and/or weight of the device. Preferably, the impact force at each high-pressure nozzle is approximately 17 grams at 15 psi. Preferably, the battery pack may be charged in approximately 30 minutes and a fully charged battery pack provides approximately 15 minutes of continuous runtime. While filters of different operating parameters may be used, it is preferred that the filter have an efficiency of at least 70 percent for particles greater than or equal to 3 microns, with a dust holding capacity of approximately 1000 mg.

As noted above, a single motor is used to drive the fan, the compressor, and the rotary valve. In a preferred embodiment, the motor is a brushed DC motor with a rated voltage of 20VDC and a rated current of 8A to provide a rated output power of approximately 80W at a target speed of 24000 RPM. Preferably, the motor has an operating efficiency of at least approximately 76 percent at the target speed.

As noted above, in a preferred embodiment, the motor drives three separate output shafts of a gearbox. In a preferred embodiment, the gearbox has an input shaft that is rotated at 23000 RPM and the output shaft for the compressor is rotated at 2500 RPM, the output shaft for the rotary valve is rotated at 400 RPM, and the output shaft for the fan is rotated at 14000 RPM. In one preferred embodiment, the gearbox includes a face gearbox that is interconnected between the motor and a spur gearbox. The face gearbox rotates the input shaft to the fan and also rotates an input shaft to the spur gearbox. The shafts for the compressor and the rotary valve are off the spur gearbox.

In a preferred embodiment, the motor is powered by a 12VDC battery pack contained NiMH batteries. Rechargeable batteries may also be used and charged with a 120VAC, 60 Hz supply voltage provided by a charger that complies with applicable UL1310 standards for class 2 power supplies. Preferably, the battery pack may be charged with a fast charge of 30 minutes. It should also be noted that a Lithium ion battery or a battery with another chemistry is possible.

The compressor preferably provides compressed air at 19 psi at the compressor's output. The compressor preferably operates at a operating speed of 2500 RPM, and provide a compressed air flow at a flow rate of 0.21 CFM. The rotary valve preferably operates a rated speed of 400 RPM, and provides pulsed air in approximately 6 ms durations with approximately 10 ml of air per pulse. Preferably, the rotary valve provides approximately 1600 pulses per minute at the rated speed. In addition, in a preferred embodiment, the outlet port of the rotary valve is rectangle; although, other geometrical shapes are possible.

The high-pressure nozzles are preferably converging-diverging supersonic nozzles. In a preferred embodiment, the device has 4 such nozzles with a linear spacing between the nozzles of approximately 1.25 inches. The air pressure at the inlet to the nozzles is approximately 18 psi whereas the air pressure at the nozzle outlet is approximately 17 psi.

The fan is preferably constructed to operate with a rated speed of 14000 RPM, has a height of approximately 0.9305 inches and outer diameter of approximately 2.9007 inches. The fan is preferably a mixed flow type of fan, as described herein, and provides air at a flow rate of 30 CFM.

Although the best mode contemplated by the inventors of carrying out the present invention is disclosed above, practice of the present invention is not limited thereto. It will be manifest that various additions, modifications, and rearrangements of the features of the present invention may be made without deviating from the spirit and scope of the underlying inventive concept. Further, when the device is used on relatively low-lying surfaces, e.g., floors, in outdoor environments, and others, it may further include wheels, be adapted to slide, or mounted to some other suitable chassis, which may render the handle segment unnecessary, allowing suitably comfortable use while removing particulate matter from such low-lying surfaces.

Moreover, the individual components need not be formed in the disclosed shapes, or assembled in the disclosed configuration, but could be provided in virtually any shape, and assembled in virtually any configuration. Furthermore, all the disclosed features of each disclosed embodiment can be combined with, or substituted for, the disclosed features of every other disclosed embodiment except where such features are mutually exclusive. The dimensions shown in the figures are merely exemplary and it is understood that the invention is not limited to the exact dimensions shown.

It is intended that the appended claims cover all such additions, modifications, and rearrangements. Expedient embodiments of the present invention are differentiated by the appended claims.

What is claimed is:

1. A portable device for dislodging particulate matter from a surface, the portable device comprising:

a body segment that is movable with respect to a surface from which particulate matter is being dislodged;

a high-pressure assembly operably connected to the body segment and generating a high-pressure fluid flow for being emitted toward the surface from which the particulate matter is being dislodged; and a nozzle assembly operatively connected to and receiving the fluid flow from the high-pressure airflow assembly, the nozzle assembly including multiple nozzles that are spaced from each other and configured to emit the fluid flow as a series of discrete pulses such that each of the multiple nozzles defines a blast diameter upon the surface from which the particulate matter is being dislodged, and wherein a cumulative blast pattern is defined by the combined blast diameters of the multiple nozzles, the cumulative blast pattern defining a coverage area that corresponds in size to an area value of a downwardly facing area of the nozzle assembly.

2. The portable device of claim 1, further comprising a nose segment that extends from the body segment, the nose segment housing the nozzle assembly therein, and wherein the blast pattern coverage area is at least as large as a downwardly facing area of the nose segment.

3. The portable device of claim 1, wherein the blast diameters of the multiple nozzles overlap each other so as to define a blast pattern that is continuous along a length or width of the coverage area.

4. The portable device of at least one of claims 1-3, the high-pressure airflow assembly further comprising a rotary valve discretely delivering volumes of fluid to the multiple nozzles.

5. The portable device claims 4, wherein the nozzles emit the fluid as a series of discrete pulses in a manner that simulates a square wave as represented in a corresponding pressure versus time plot.

6. The portable device of claim 4, the rotary valve further comprising an inner sleeve that is provided concentrically inside of and supporting a manifold sleeve.

7. The portable device of claim 6, the rotary valve further comprising a rotating component extending axially into the inner sleeve and being supported by a support shaft that accepts pressurized fluid from the high-pressure assembly.

8. The portable device of claim 7, wherein the rotating component is rotated by a gear-train that is driven by a prime mover.

9. The portable device of claim 7, wherein the gear-train drives at least one other component in addition to the rotating component.

10. The portable device of claim 1, wherein each of the multiple nozzles further comprises a frusto-conical flange defined at an end thereof, and an opening extending axially into the frusto-conical flange.

* * * * *